United States Patent [19]

Adachi

[11] 4,321,851

[45] Mar. 30, 1982

[54] ELECTRONIC MUSICAL INSTRUMENT

[75] Inventor: Takeshi Adachi, Hamamatsu, Japan

[73] Assignee: Nippon Gakki Seizo Kabushiki Kaisha, Japan

[21] Appl. No.: 162,567

[22] Filed: Jun. 24, 1980

[30] Foreign Application Priority Data

Jun. 28, 1979 [JP] Japan ..... 54-81625

[51] Int. Cl.[3] ..... G10H 1/00

[52] U.S. Cl. ..... 84/1.01; 84/DIG. 7; 84/DIG. 20

[58] Field of Search ..... 307/35, 140; 364/707; 84/DIG. 7, 1.01, DIG. 20, 1.03

[56] References Cited

U.S. PATENT DOCUMENTS 3,918,342 11/1975 Mieda ..... 84/DIG. 20

4,177,705 12/1979 Evangelista ..... 84/DIG. 7

4,203,340 5/1980 Ostrom ..... 84/DIG. 20

4,268,815 5/1981 Eventoff et al. ..... 84/DIG. 7

*Primary Examiner*—J. V. Truhe

*Assistant Examiner*—Forester W. Isen

*Attorney, Agent, or Firm*—Townsend and Townsend

[57] ABSTRACT

An electronic musical instrument comprises a power source switch, a keyboard including a plurality of key switches corresponding to a plurality of keys, a signal generator for generating a musical tone signal corresponding to a note of a depressed key, and a loudspeaker driven by an output of the signal generator for producing a musical tone. In the instrument, the power source switch is interlocked with the key depression operation so as to supply power to the electronic musical instrument only when a key is depressed.

29 Claims, 9 Drawing Figures

ELECTRONIC MUSICAL INSTRUMENT

BACKGROUND OF THE INVENTION

This invention relates to an electronic musical instrument, and more particularly a power supply circuit thereof.

For electronic musical instruments two types of power sources have been used, one a commercial AC source and the other a DC power source or a battery. In each type, the electronic musical instrument is constructed such that when a key is depressed after closing a source switch, a musical tone corresponding to the depressed key is produced. In such an electronic musical instrument, the performer often fails to open the power source switch after finishing the performance. This causes loss of power of a battery especially in a portable electronic musical instrument utilizing the battery as the power source. In the portable electronic musical instrument, unless the power consumption during performance is limited, the life of the battery will be shortened. This requires frequent renewal of the battery or use of a battery of a large capacity, so that use of a large battery increases the size and weight of the electronic musical instrument which makes it inconvenient to transport the same.

SUMMARY OF THE INVENTION

Accordingly, it is the principal object of this invention to provide an electronic musical instrument capable of preventing undesirable power consumption when a performer forgets to open the source switch.

Another object of this invention is to provide an electronic musical instrument capable of reducing the power consumption during performance.

Still another object of this invention is to provide an improved electronic musical instrument of the portable type containing a small size DC power source and which can reduce the power consumption during performance.

A further object of this invention is to provide an electronic musical instrument in which the power supply is controlled in an interlocked relationship with a key depressing operation.

According to this invention there is provided an electronic musical instrument comprising a power source; a plurality of keys; key switch means including a plurality of key switches corresponding to respective keys; means for generating a signal corresponding to a note of a depressed key, the signal generating means including a source terminal adapted to be supplied with voltage of said power source and a control input terminal adapted to be supplied with a control input corresponding to the note of the depressed keys; power source switch means interposed between the power source and the source terminal and interlocked with a depression of the key; means responsive to the depression of the key for supplying a control signal corresponding to a musical tone signal to be produced to the control input terminal, and means for producing a musical tone in accordance with an output of the signal generating means.

The source switch means and the key switch means may be constructed as independent switch means or as a single common switch means.

DESCRIPTION OF THE PREFERRED EMBODIMENTS

Figure 1:
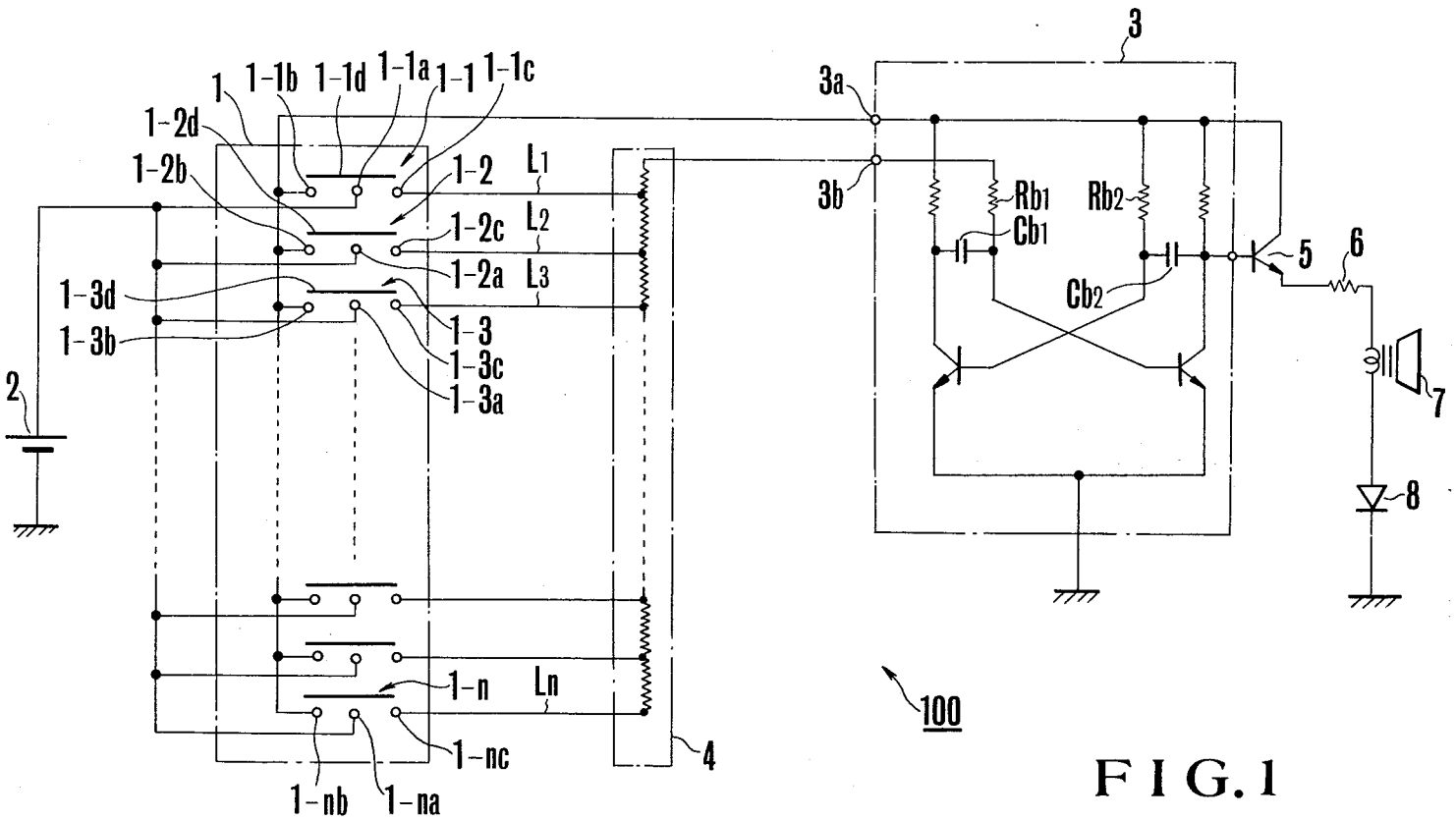
FIG. 1 is a connection diagram showing one embodiment of the electronic musical instrument according to this invention.

A preferred embodiment of the electronic musical instrument 100 according to this invention and shown in FIG. 1 utilizes an astable multivibrator and the oscillation frequency thereof is controlled by varying the resistance value of the resistor connected to the base electrode of one of the transistors of the oscillator.

A key switch unit 1 comprises a plurality of key switches 1-1 through **1-*n* respectively corresponding to keys 10-1 through 10-*n* (shown in FIG. 2) of the electronic musical instrument, and the key switches 1-1 through 1-*n* are ON-OFF controlled according to the operation of respective keys. Each key switch is provided with a movable contact and three-stationary contacts cooperating therewith. One of the stationary contacts is connected to one pole of a DC source, for example a battery 2 with the other pole grounded, whereas another one of the stationary contacts is connected to a source terminal 3*a* of an oscillator 3. Yet another stationary contact is connected to a control terminal 3*b* of the oscillator 3 through a frequency controlling resistor 4. Taking the key switch 1-1 as an example, a movable contact 1-1*d* is constructed to simultaneously engage all stationary contacts 1-1*a*, 1-1*b* and 1-1*c*. At this time, the stationary contact 1-1*a* is connected to the source 2, the stationary contact 1-1*b* is connected to the source terminal 3*a* of the oscillator 3 and the stationary contact 1-1*c* is connected to the control terminal 3*b* through an output line $L_1$ and the frequency controlling resistor 4**.

Figure 2:
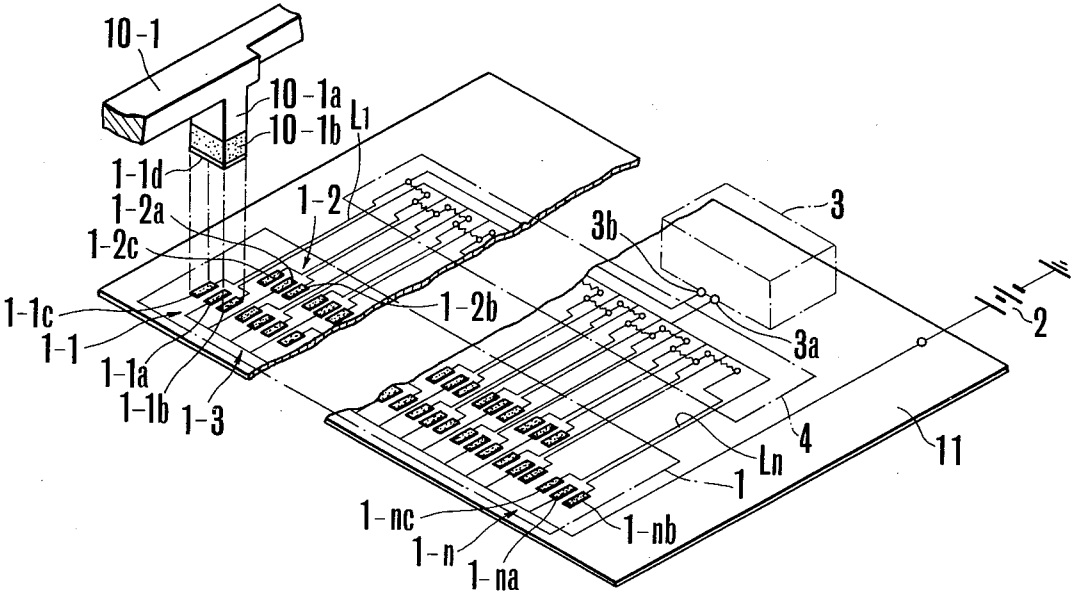
FIG. 2 is a perspective view showing the detail of a key switch unit shown in FIG. 1.

One example of the actual construction of the key switch unit 1 is illustrated in FIG. 2 which shows only a key 10-1 corresponding to the highest tone pitch, and other keys 10-2 through **10-*n* are not shown. As shown, the key 10-1 is formed with a downwardly projecting actuator 10-1*a* and a resilient member 10-1*b* is secured to the lower end of the actuator 10-1*a*. A metal foil, for example, an aluminum foil acting as the movable contact 1-1*d* is bonded to the lower surface of the resilient member 10-1*b*. Stationary contacts 1-1*a*, 1-1*b* and 1-1*c* are mounted on a printed substrate 11 located beneath the movable contact 1-1*d*. Thus, when the key 10-1 is depressed it simultaneously engages the stationary contacts 1-1*a*, 1-1*b* and 1-1*c*, thus interconnecting the stationary contacts through the movable contacts. Accordingly, the source terminal 3***a* of the oscillator is connected to the source 2 to energize the oscillator 3. The control terminal 3*b* of the oscillator is also connected to the source 2 through the outut line $L_1$ and the frequency controlled resistor 4. By bonding the movable contact 1-1*d* to the resilient member 10-1*b* through the metal foil 1-1*d*, it is possible to reduce the contact resistance when the movable contact 1-1*d* is depressed against the stationary contacts 1-1*a*, 1-1*b* and 1-1*c*.

The oscillator 3 shown in FIG. 1 comprises an astable multivibrator which produces a musical tone signal having a frequency corresponding to the tone pitch of the depressed key. The oscillation frequency of the oscillator 3 is controlled by the resistance value of the frequency controlling resistor 4. More particularly, the frequency controlling resistor 4 is constituted by a plurality of serially connected resistors defined by a plurality of intermediate taps, and respective key switches 1-1 through 1-*n* are connected to intermediate taps of the resistor 4 where the resistance values between respective key switches 1-1 through 1-*n* and the control terminal 3*b* of the oscillator 3 assume the values corresponding to the tone pitches of respective keys. Assume now that the resistance between one of the depressed key switches 1-1 through 1-*n* and the control terminal 3*b* is denoted by Rn and that the elements (resistor and capacitor) constituting the oscillator 3 have values as shown in FIG. 1, the period $T_1$ of the musical tone signal produced by the oscillator 3 is expressed by the following equation.

$$T_1 = 0.7\ Cb_2 \cdot Rb_2 + 0.7\ Cb_1 \cdot (Rn + Rb_1)$$

The musical tone signal generated by the oscillator 3 is applied directly, or through a suitable tone color filter (not shown), to a loudspeaker 7 via a transistor 5 and a resistor 6 to be produced as a musical tone. A light emitting diode (LED) 8 is connected between the loudspeaker 7 and the ground to display a state of a performance. Where the key 10-1 of the highest tone pitch is depressed, the movable contact 1-1*d* of the key switch engages the stationary contacts 1-1*a*, 1-1*b* and 1-1*c* to apply the source voltage to the source terminal 3*a* of the oscillator 3 while a control voltage is applied to the control terminal 3*b* to produce a musical tone signal from the oscillator 3 corresponding to the depressed key 10-1 thus producing a musical tone from the loudspeaker 7.

Figure 3:
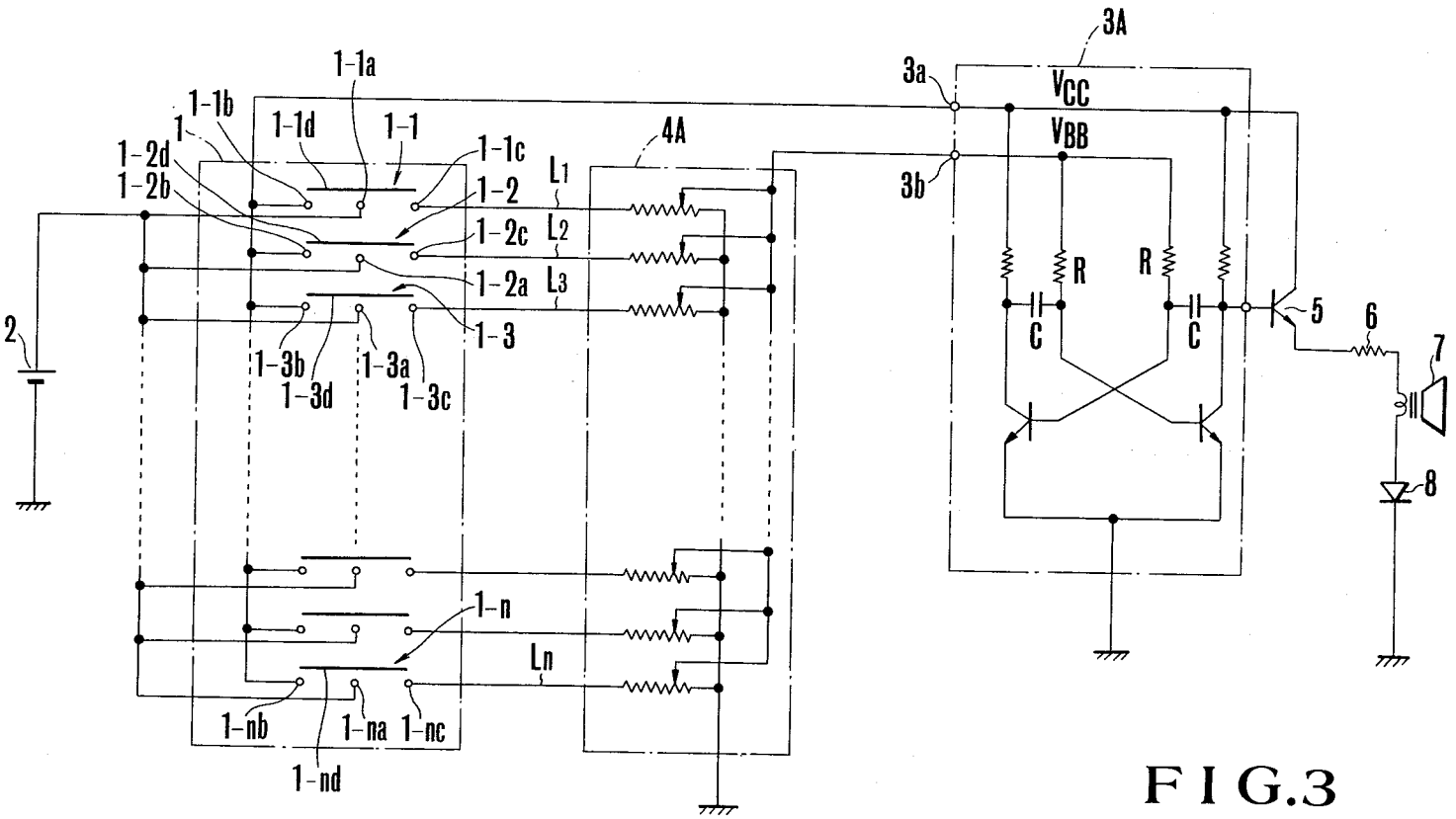
FIG. 3 is a connection diagram showing a modified embodiment of the electronic musical instrument according to the present invention.

In a modified embodiment of this invention shown in FIG. 3, the oscillation frequency is controlled by varying the base voltage of an astable multivibrator and in FIG. 3, elements corresponding to those shown in FIG. 1 are designated by the same reference charactors.

In the modification shown in FIG. 3, although the oscillator 3A comprises an astable multivibrator in the same manner as that shown in FIG. 1, its oscillation frequency is controlled according to its base voltage $V_{BB}$ which is supplied from a frequency controlling resistor 4A. More particularly, this resistor 4A is made up of a plurality of resistors having values corresponding to the tone pitches of keys so that the voltage supplied from the source 2 via a depressed key switch (one of the switches 1-1 through 1-*n*) is adjusted to a voltage corresponding to the tone pitch of the depressed key and the voltage $V_{BB}$ thus produced is applied to the control terminal 3*b* of the oscillator 3A. Denoting the base voltage by $V_{BB}$, the base-emitter voltage by $V_{BE}$, and the collector voltage by $V_{CC}$ and suppose that the resistor and the capacitor have values shown in FIG. 3, the period $T_2$ of the musical tone signal generated by the oscillator 3A is expressed by the following equation.

$$T_2 = 2CRl_n\left(1 + \frac{V_{CC}}{V_{BB} - V_{BB}}\right)$$

With this construction, where either one of the keys is depressed, the voltage of the source 2 would be applied to the source terminal 3*a* of the oscillator 3A while at the same time, a voltage corresponding to the tone pitch of the depressed key would be applied to the control terminal 3*b* so that the oscillator 3A produces a musical tone signal having a frequency corresponding to the tone pitch of the depressed key and the musical tone signal is produced as a musical tone by the loudspeaker 7.

Figure 4:
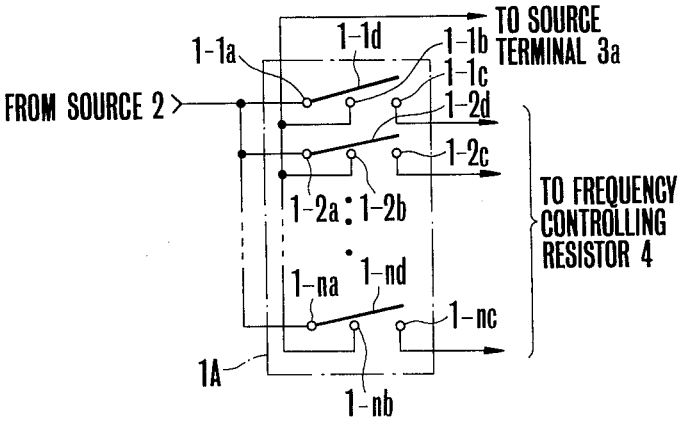
FIG. 4 is a connection diagram showing a modified key switch unit.

Although in the foregoing embodiment each key switch is constituted by one movable contact and three stationary contacts (with reference to key switch 1-1, one movable contact 1-1*d* and three stationary contacts 1-1*a*, 1-1*b* and 1-1*c*) the key switch may be constructed as a key switch unit 1A shown in FIG. 4 in which elements corresponding to those shown in FIG. 1 are designed by the same reference characters.

Figure 5:
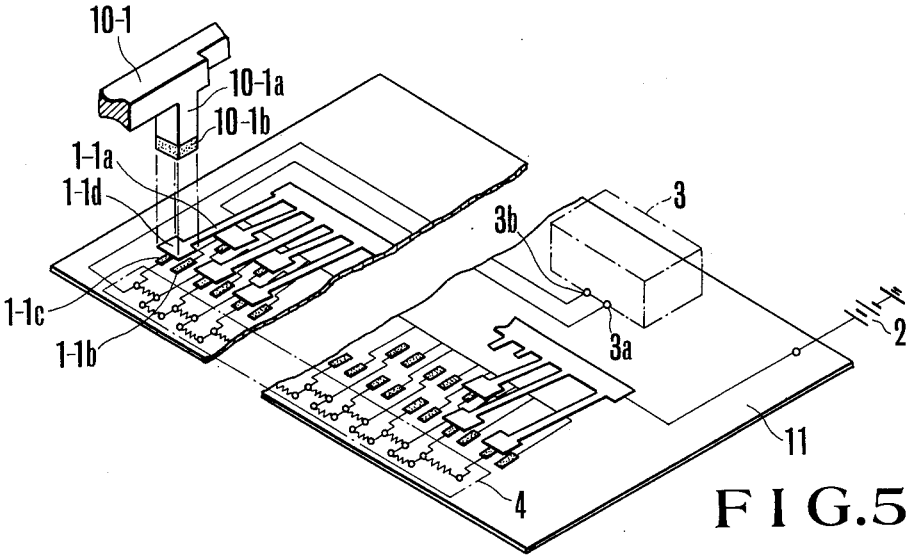
FIG. 5 is a perspective view showing an actual construction of the key switch unit shown in FIG. 4.

In the modification shown in FIG. 4, one end of the movable contact 1-1*d* is normally connected to the stationary contact 1-1*a* so that when the key 10-1 is depressed, the movable contact 1-1*d* engages the stationary contacts 1-1*b* and 1-1*c*. Actually, the switch unit 1A is constructed as shown in FIG. 5. More particularly, only a resilient member 10-1*b* is secured to the lower end of the actuator 10-1*a* of the key 10-1 and the stationary contacts corresponding to the stationary contacts 1-1*b* and 1-1*c* shown in FIG. 4 are mounted on the printed substrate 11 and one end of the movable contact 1-1*d* in the form of a leaf spring is secured to the printed substrate 11 such that its other end will be positioned above the stationary contacts 1-1*b* and 1-1*c*.

The voltage of the source 2 is applied to the movable contact 1-1*d*. Thus, as the key 10-1 is depressed, the movable contact 1-1*d* bridges the stationary contacts 1-1*c* and 1-1*b* to supply the source voltage to the source terminal 3*a* of the oscillator 3. At the same time, the source voltage is supplied to the control terminal 3*b* of the oscillator 3 via the movable contact 1-1*a*, the stationary contact 1-1*c* and the frequency control resistor 4. As a consequence, the oscillator 3 produces a tone source signal having a frequency corresponding to the tone pitch of the depressed key 10-1, and the signal is converted into a musical tone by the loudspeaker 7.

Figure 6:
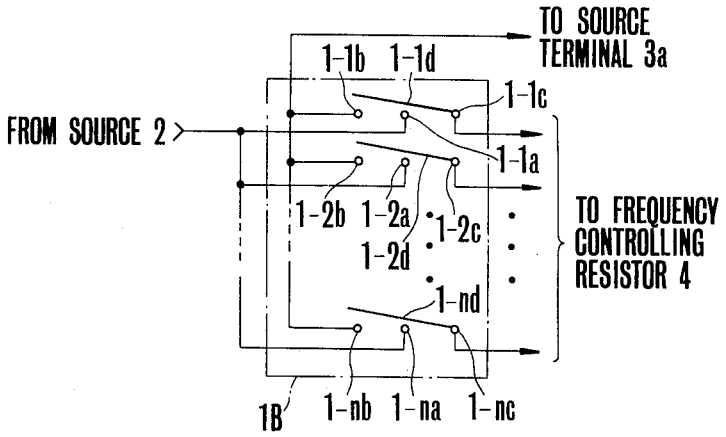
FIG. 6 is a connection diagram showing still another modification of the key switch unit embodying the invention.
Figure 7:
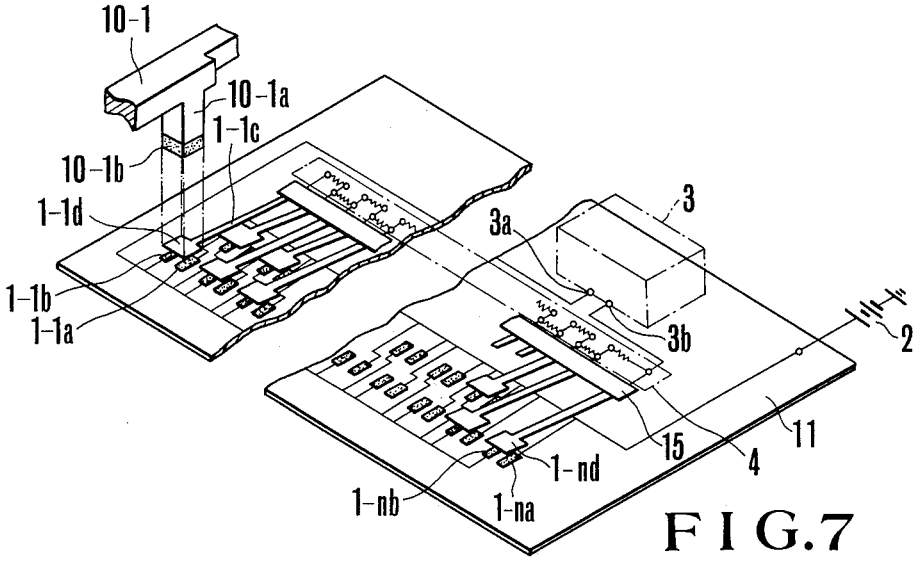
FIG. 7 is a perspective view showing an actual construction of the key switch unit shown in FIG. 6.

FIG. 6 illustrates another modification of a key switch unit 1B. In this modification, one end of the movable contact 1-1*d* is normally connected to the stationary contact 1-1*c* so that when the key is depressed the movable contact 1-1*d* engages the stationary contacts 1-1*a* and 1-1*b*. The actual construction of the key switch unit 1-B is shown in FIG. 7. Thus, a resilient member 10-1*b* is attached to the lower end of the actuator 10-1*a* of the key 10-1 and the stationary contacts 1-1*a* and 1-1*b* are mounted on the printed substrate 11. One end of the movable contact 1-1*d* in the form of a leaf spring is secured to the printed substrate 11 such that its other end is positioned above the stationary contacts 1-1*a* and 1-1*b*. The voltage of the source 2 is applied to the stationary contact 1-1*c*. Upon depression of the key 10-1, the movable contact 1-1*d* is caused to engage stationary contacts 1-1*a* and 1-1*b* to apply the source voltage to the source terminal 3*a* of the oscillator 3 via these movable and stationary contacts. At the same time, the source voltage is applied to the control terminal 3*b* of the oscillator via the stationary contact 1-1*a*, the movable contact 1-1and the frequency controlling resistor 4 with the result that the oscillator 3 produces a tone source signal having a frequency corresponding to the tone pitch of the depressed key 10-1 thus producing a musical tone by the loudspeaker 7. In FIG. 7, an insulating strip 15 is provided for clamping one end of the movable contacts 1-1*d*, 1-2*d*–1-*nd* to the printed substrate 11.

Figure 8:
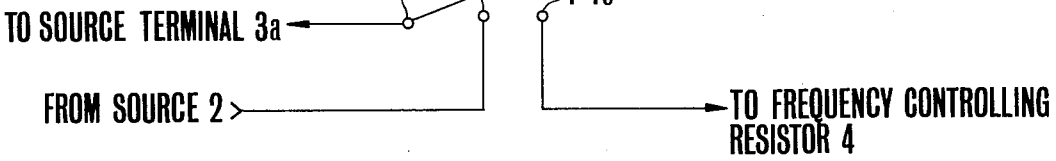
FIG. 8 is a connection diagram showing another modification of the key switch unit embodying the invention.

Alternatively, as shown in FIG. 8, the movable contact 1-1*d* may be normally connected to the stationary contact 1-1*b*.

Figure 9:
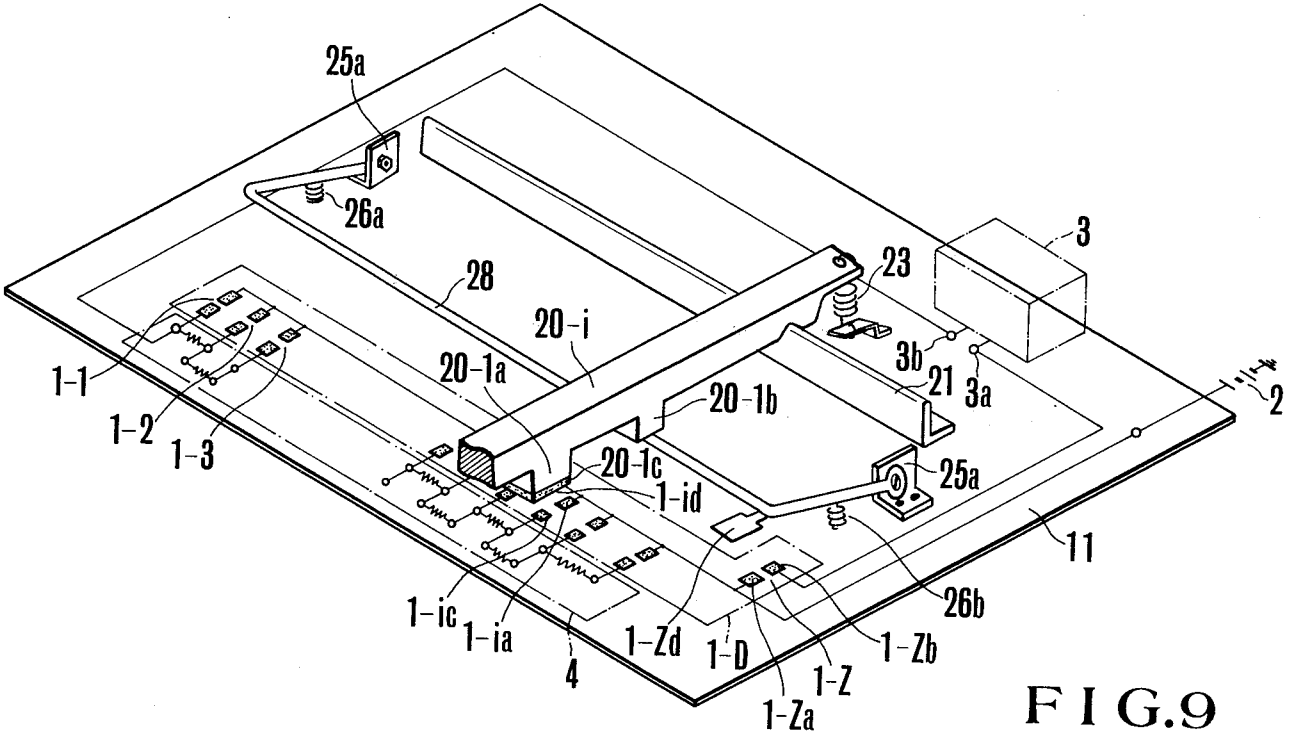
FIG. 9 is a perspective view showing the actual construction of another modification of the key switch unit.

FIG. 9 illustrates still another modification of this invention. In a key switch unit 10 shown in FIG. 9, a single source switch is commonly used for respective keys. Thus, the key switch unit 10 including key switches 1-1 through 1-*n* is also provided with a source switch 1-Z, which are arranged on the printed substrate 11 as shown. A supporting bar 21 is mounted on the substrate 11 for supporting keys corresponding to respective key switches. For the sake of simplicity, only one key 20-*i* is shown. One end of this key 20-*i* is supported by a spring 23 with its lower end anchored by the substrate 11. Downwardly projecting actuators 20-1*a* and 20-1*b* are provided for the key 20-*i* at portions beyond the supporting bar 21. A resilient member 20-1*c* is secured to the lower end of the actuators 20-1*a*, and the movable contact 1-*id* is bonded to the lower surface of the resilient member 20-1*c*. The movable contact 1-*id* may be made of a foil of metal, aluminum for example and stationary contacts 1-*ia* and 1-*ic* are mounted on the substrate 11 to confront the movable contact 1-*id*. The stationary contact 1-*ic* is connected to the frequency controlling resistor 4 having the same construction as that shown in FIG. 1 and its output is coupled to the control terminal 3*b* of the oscillator 3. The other actuator 20-1*b* engages a U shaped bar 28 rotatably mounted on the substrate 11 and normally biased upwardly by springs 26*a* and 26*b*. A metal plate 1-Z*d* constituting the movable contact of the source switch 1-Z is secured to a suitable portion of the bar 28. Stationary contacts 1-Z*a* and 1-Z*b* are secured to the substrate 11 to oppose the metal plate 1-Z*d*. The stationary contact 1-Z*a* is connected to the source 2 while contact 1-Z*b* is connected to the source terminal 3*a* of the oscillator 3.

In this modification as the key 20-*i* is depressed, the bar 28 is rotated downwardly to cause the movable contact 1-Z*d* to engage with the stationary contacts 1-Z*a* and 1-Z*b* to supply the source voltage to the source terminal 3*a* of the oscillator 3. At the same time, the movable contact 1-*id* of the key switch 1-*i* engages the stationary contacts 1-*ia* and 1-*ic* to connect the source 2 to the frequency controlling resistor 4. As the key is released it is raised by spring 23 to open key switches 1-*ia* and 1-*iz*. As above described the key and the source switch are interlocked.

It should be understood that the invention is not limited to the specific embodiments described above and that many changes and modifications may be made without departing the spirit and scope of the invention. For example instead of using an astable multivibrator as an oscillator any other variable frequency oscillator may be used, for example a resistance controlled LC oscillator or a voltage controlled oscillator. Although in FIG. 1, a source switch is also used as a stationary contact for connecting a source, four independent stationary contacts can also be used. Further instead of using a single oscillator actuated by respective key switches a plurality of independent oscillators corresponding to respective key switches can be used. In addition, it is also possible to provide an oscillator for the highest octave and to divide the output frequency of the oscillator where a key of a lower octave is depressed.

A mechanical switch shown in the drawings may be substituted by a pressure sensitive switch, a photoswitch, a reed switch and any other well known switch, or a combination of switches having different performances, and a battery may be substituted by a commercial AC source.

As above described, according to this invention, a key switch is interlocked with a source switch or constructed to act also as a source switch so as to supply the source voltage to a musical tone producing circuit only when the key switch is closed. As a consequence it is possible to prevent power consumption caused by the failure of a performer to open the source switch.

What is claimed is:

1. An electronic musical instrument comprising:

a power source;

a plurality of keys;

means for generating a signal corresponding to a note of a depressed key, said signal generating means including a source terminal adapted to be supplied with voltage from said power source and a control input terminal adapted to be supplied with a control signal corresponding to the note of the depressed key.

electric power connecting means interposed between said power source and said source terminal and interlocked with a depression of at least one of said keys, said electric power connecting means being normally open so that no power is applied to said source terminal;

means responsive to the depression of at least one of said keys for supplying said control signal corresponding to a musical tone signal to be produced to said control input terminal; and means for producing a musical tone in accordance with an output of said signal generating means.

2. An electronic musical instrument according to claim 1 wherein said musical tone producing means comprises a loudspeaker.

3. An electronic musical instrument according to claim 1 wherein said musical tone producing means comprises:

an amplifier for amplifying a signal generated by said signal generating means;

said amplifier including a source terminal connected to receive a bias voltage from said power source via said electric power connecting means; and a loudspeaker driven by an output of said amplifier.

4. An electronic musical instrument according to claim 1 wherein said signal generating means comprises a voltage controlled type oscillator.

5. An electronic musical instrument according to claim 1 wherein said signal generating means comprises a resistance controlled type CR oscillator.

6. An electronic musical instrument according to claim 1 which further comprises:

key switch means including a plurality of key switches corresponding to the respective keys.

7. An electronic musical instrument according to claim 6 wherein said control signal supplying means comprises a resistor provided with a plurality of intermediate taps, one end of said key switches being connected to respective taps of said resistor, while the other ends of said key switches are commonly connected to said power source, and one end of said resistor being connected to said control input terminal.

8. An electronic musical instrument according to claim 6 wherein said control signal connecting means comprises a plurality of potentiometer resistors with variable taps of the same number as said key switches, one end of each of the potentiometer resistors being connected to one terminal of a respective key switch while the other end of each of said potentiometer resistors is connected to a source of reference potential, the taps being commonly connected to said control input terminal and the other terminal of said key switches being commonly connected to said power source.

9. An electronic musical instrument according to claim 6 wherein said electric power supplying means comprises:

a first stationary contact connected to said power source;

a second stationary contact connected to said source terminal of said signal generating means; and a first movable contact caused to engage said first and second stationary contacts when a key is depressed, and wherein each of said key switches comprises:

a third stationary contact connected to said control signal supplying means;

a fourth stationary contact connected to said power source; and a second movable contact caused to engage said third and fourth stationary contacts when a key is depressed, whereby said key is depressed said first and second movable contacts are caused to engage the stationary contacts associated therewith so that said stationary contacts are mutually interconnected through said movable contacts, respectively.

10. An electronic musical instrument according to claim 6 wherein said electric power connecting means and said key switch means are constituted by a single switch means provided for each key, said single switch means comprising:

a first stationary contact connected to said power source;

a second stationary contact connected to said source terminal of said signal generating means;

a third stationary contact connected to said control signal supplying means; and a movable contact normally disengaged from said stationary contacts and caused to engage said first, second and third stationary contacts when a key is depressed.

11. An electronic musical instrument according to claim 9 or 10 wherein the movable contact of said key switch comprises:

a resilient member secured to a lower surface of said key; and a metal member bonded to a lower surface of said resilient member.

12. An electronic musical instrument according to claim 9 wherein said electric power connecting means is provided one for each one of said keys, so as to cause the movable contact of said electric power connecting means to engage said first and second stationary contacts when any one of the keys is depressed.

13. An electronic musical instrument according to claim 6 wherein each of said key switch means comprises:

a first stationary contact connected to said power source;

a second stationary contact connected to the source terminal of said signal generating means;

a third stationary contact connected to said control signal supply means; and a movable contact with one end connected to one of said stationary contacts and the other end caused to engage the remaining stationary contacts when a key is depressed so as to interconnect said stationary contacts through said movable contact.

14. An electronic musical instrument comprising:

a power source;

a plurality of keys;

means for generating a signal corresponding to a note of a depressed key among said keys;

means for connecting power from said power source to said signal generating means while at least one key among said keys is depressed, said power connecting means being normally open so that no power is applied to said signal generating means in the absence of a depressed key; and means for producing a musical tone in accordance with an output signal of said signal generating means.

15. An electronic musical instrument according to claim 14 wherein said musical tone producing means comprises a loudspeaker.

16. An electronic musical instrument according to claim 15 wherein said musical tone producing means further comprises:

an amplifier for amplifying said output signal of said signal generating means to drive said loudspeaker and wherein said power supplying means further supplies power to said musical tone producing means.

17. An electronic musical instrument comprising:

a plurality of keys;

a power source means for delivering electric power;

means for generating a musical tone signal in response to a key depression, said musical tone signal generating means including a first source terminal adapted to be supplied with said electric power which powers said musical tone signal generating means;

electric power connecting means for connecting said electric power to said first source terminal when a key among said plurality of keys is depressed so that said musical tone signal generating means is powered and generates said musical tone signal, said electric power connecting means being normally open so that no power is connected to said first source terminal when no key is depressed; and means for producing a musical tone corresponding to said musical tone signal of said musical tone signal generating means.

18. An electronic musical instrument according to to claim 17 further comprising:

means for generating a control signal which corresponds to a note of a depressed key, said control signal generating means including a second source terminal adapted to be supplied with said electric power which powers said control signal generating means;

and wherein said electric power connecting means further connects said electric power to said second source terminal when said key among said plurality of keys is depressed so that said control signal generating means is enabled to generate said control signal, said electric power connecting means being normally open so that no power is applied to said second source terminal when no key is depressed; and said musical tone signal generating means further includes a control terminal, said control signal being supplied to said control terminal so that said musical tone signal is related to said note of said depressed key.

19. An electronic musical instrument according to claim 17 wherein said electric power connecting means is inserted between said power source means and said first source terminal, said electric power being supplied via said electric power connecting means.

20. An electronic musical instrument according to claim 18 wherein said electric power connecting means is inserted between said power source means and said second source terminal, said electric power being supplied via said electric power connecting means.

21. An electronic musical instrument according to claim 18 wherein said control signal generating means comprises a resistor provided with said second source terminal comprising a plurality of intermediate taps which correspond to said plurality of keys respectively, one end of said resistor being connected to said control terminal; and wherein said musical tone signal generating means comprises a resistance controlled type CR oscillator, said musical tone signal having a frequency corresponding to said note of said depressed key in accordance with said control signal.

22. An electronic musical instrument according to claim 18 wherein said control signal generating means comprises a plurality of potentiometer resistors, which correspond to said plurality of keys and one end of which commonly connected to reference potential, with variable taps, said second source terminal comprising the other end of each of said potentiometer resistors, said variable taps being commonly connected to said control input terminal of said musical tone signal generating means and supplying said control signal having a voltage corresponding to the said note of said depressed key; and wherein said musical tone signal generating means comprises a voltage controlled type oscillator, said musical tone signal having a frequency corresponding to said note of said depressed key in accordance with said voltage of said control signal.

23. An electronic musical instrument according to claim 18 wherein said second source terminal of said control signal generating means comprises a plurality of source taps which correspond to said plurality of keys, respectively.

24. An electronic musical instrument according to claim 23 wherein said electronic power connecting means comprises a plurality of switches corresponding to said plurality of keys, respectively, each switch having a first stationary contact, a second stationary contact, and a movable contact, interlocked with corresponding key depression, connected to said first stationary contact and for causing said second and third contacts and said first stationary contacts through said movable contact to engage in response to said corresponding key depression.

25. An electronic musical instrument according to claim 23 wherein said electric power connecting means comprises a plurality of switches corresponding to said plurality of keys, respectively, each switch having a first stationary contact, a second stationary contact, a third stationary contact, and a movable contact interlocked with a corresponding key depression and for causing said first, second and third stationary contacts to engage each other through said movable contact in response to said corresponding key depression.

26. An electronic musical instrument according to claim 24 or 25 wherein one among said first, second and third stationary contacts is connected to said power source means, one of the remaining two contacts is connected to said first source terminal of said musical tone signal generating means, and the other of said remaining two contacts is connected to the source tap of the switch corresponding to said depressed key among said plurality of taps of said second source terminal.

27. An electronic musical instrument according to claim 23 wherein said electric power connecting means comprises a first switch comprising a first stationary contact connected to said power source means, a second stationary contact connected to said first source terminal of said musical tone signal generating means; and a first movable contact interlocked with any key depression and for causing said first and second stationary contacts to engage through said first movable contact in response to said any key depression;

and a plurality of second switches corresponding to said plurality of keys, respectively, each of said plurality of second switches comprising a third stationary contact connected to the tap of the switch corresponding to said depressed key among said plurality of taps of said second source terminal of said control signal generating means, a fourth stationary contact connected to said power source means; and a second movable contact interlocked with a corresponding key and for causing third and fourth stationary contacts to engage in response to said corresponding key depression.

28. An electronic musical instrument according to claims 24 or 25 wherein said movable contact is a metal member, said metal member being bonded to a lower surface of said corresponding key.

29. An electronic musical instrument according to claim 27 wherein said plurality of second movable contacts comprise metal members, said metal members being bonded to lower surfaces to said plurality of keys, respectively.

* * * * *

UNITED STATES PATENT AND TRADEMARK OFFICE

CERTIFICATE OF CORRECTION

PATENT NO. : 4,321,851

DATED : March 30, 1982

INVENTOR(S) : Takeshi Adachi, Hamamatsu, Japan

It is certified that error appears in the above—identified patent and that said Letters Patent is hereby corrected as shown below:

In column 8, line 63, change "according to to" to --according to--.

Signed and Sealed this

*Seventeenth* Day of *August 1982*

[SEAL]

*Attest:*

GERALD J. MOSSINGHOFF

*Attesting Officer*

*Commissioner of Patents and Trademarks*